US009994796B2

(12) United States Patent
Hahn et al.

(10) Patent No.: US 9,994,796 B2
(45) Date of Patent: Jun. 12, 2018

(54) COMPOSITION FOR USING IN THE PROTECTION OF NON-METALLIC INORGANIC MATERIAL

(75) Inventors: Karlheinz Ulrich Hahn, Ludwigshafen (DE); Karin Werner, Ludwigshafen (DE)

(73) Assignee: RECKITT BENCKISER FINISH B.V., hoofddorp (NL)

( * ) Notice: Subject to any disclaimer, the term of this patent is extended or adjusted under 35 U.S.C. 154(b) by 1440 days.

(21) Appl. No.: 13/059,270

(22) PCT Filed: Aug. 14, 2009

(86) PCT No.: PCT/GB2009/002003

§ 371 (c)(1),
(2), (4) Date: Apr. 7, 2011

(87) PCT Pub. No.: WO2010/020765

PCT Pub. Date: Feb. 25, 2010

(65) Prior Publication Data

US 2011/0183883 A1 Jul. 28, 2011

(30) Foreign Application Priority Data

Aug. 16, 2008 (GB) ..... 0815022.9

(51) Int. Cl.
*C11D 3/00* (2006.01)
*C11D 3/37* (2006.01)
*C11D 11/00* (2006.01)

(52) U.S. Cl.
CPC ..... *C11D 3/0073* (2013.01); *C11D 3/3723* (2013.01); *C11D 11/0035* (2013.01)

(58) Field of Classification Search
USPC ..... 510/514, 499; 134/25.2
See application file for complete search history.

(56) References Cited

U.S. PATENT DOCUMENTS

| | | | | |
|---|---|---|---|---|
| 5,670,468 | A * | 9/1997 | Moens | C11D 3/168 510/220 |
| 5,981,456 | A * | 11/1999 | Tartakovsky | C11D 3/0073 510/220 |
| 6,326,343 | B1 * | 12/2001 | Ghatlia | C11D 3/3769 134/25.2 |
| 6,475,977 | B1 * | 11/2002 | Pfeiffer | C11D 3/3945 510/221 |
| 2003/0171246 | A1 | 9/2003 | Boeckh | |
| 2005/0176599 | A1 | 8/2005 | Bergquist | |
| 2007/0272277 | A1 * | 11/2007 | Jeffreys | 134/25.2 |
| 2007/0275868 | A1 * | 11/2007 | Cooremans | C11D 3/3723 510/475 |

FOREIGN PATENT DOCUMENTS

| | | | |
|---|---|---|---|
| WO | 199532272 | A1 | 11/1995 |
| WO | 199905248 | A1 | 2/1999 |
| WO | 199907815 | A1 | 2/1999 |
| WO | 200196516 | A1 | 12/2001 |
| WO | 2006108857 | A1 | 10/2006 |

OTHER PUBLICATIONS

Combined Search and Examination Report from GB Application No. GB0815022.9, dated Dec. 17, 2008.

* cited by examiner

*Primary Examiner* — Ling Siu Choi
*Assistant Examiner* — Thuy-Ai N Nguyen
(74) *Attorney, Agent, or Firm* — Troutman Sanders LLP; Ryan Schneider; Chris Davis

(57) ABSTRACT

The present invention provides the use of a composition comprising a polyalkyleneimine and/or salts or derivative thereof for the prevention of corrosion of non-metallic in organic items during a washing or rinsing process, in particular during an automatic dishwashing process.

7 Claims, No Drawings

COMPOSITION FOR USING IN THE PROTECTION OF NON-METALLIC INORGANIC MATERIAL

This is an application filed under 35 USC 371 of PCT/GB2009/002003, which was filed on 14 Aug. 2009, which in turn claims priority to GB 0815022.9 filed 16 Aug. 2008.

TECHNICAL FIELD

The present invention relates to a composition for use in the protection of non-metallic inorganic materials such as glassware in an automatic dishwashing process.

BACKGROUND

The problem of corrosion of non-metallic inorganic items, such as glassware, ceramic and enamel materials, when subjected to automatic dishwashing processes is well recognised in the art. For example, it has been proposed that the problem of glassware corrosion is the result of two separate phenomena. Firstly, it is suggested that the corrosion is due to leakage of minerals from the glass network, accompanied by hydrolysis of the silicate network. Secondly, silicate material is suggested to be released from the glass.

These phenomena can cause damage to glassware after a number of separate wash cycles. The damage may include cloudiness, scratches, streaks and other discoloration/detrimental effects.

Silicate materials have been suggested to be effective in preventing materials from being released by the glass composition. However, the use of silicate compounds can have detrimental side effects, such as the tendency to increase separation of silicate material at the glass surface.

A further solution has been to use zinc, either in metallic form (such as described in U.S. Pat. No. 3,677,820) or in the form of compounds. The use of soluble zinc compounds in the prevention of glassware corrosion in a dishwasher is described in, for example, U.S. Pat. No. 3,255,117.

However, the use of soluble zinc compounds can give rise to detrimental side effects, such as the development of a precipitate of insoluble zinc compounds formed by interaction with other species typically present in the dishwasher wash liquor. This has meant that often insoluble (or rather sparingly soluble) zinc compounds are preferred as the source of zinc in the dishwasher wash liquor. European Patents; EP-A-0 383 480, EP-A-0 383 482 and EP-A-0 387 997) describe the use of water insoluble compounds including zinc silicate, zinc carbonate, basic zinc carbonate ($Zn_2(OH)_2CO_3$), zinc hydroxide, zinc oxalate, zinc monophosphate ($Zn_3(PO_4)_2$) and zinc pyrophosphate ($Zn_2P_2O_7$) for this purpose.

As these zinc compounds have only a low solubility in water it is usual that the compounds are required to have a relatively high surface area, achieved by having a small particle size, in order to attempt to achieve a sufficient concentration in water to obtain the required glass corrosion prevention effect. In this regard EP-A-0 383 480 and EP-A-0 387 997 specify that the zinc compound should have a particle size of lower that 250 μm, whereas EP-A-0 383 482 specifies a particle size of lower than 1.7 mm. However, the use of a small particle size has not been found to overcome the delivery issue and thus, with the use of these insoluble compounds, the problem of glass corrosion effects remain.

The use of glasses and ceramics containing zinc has been found to address the problem of glassware corrosion in a dishwasher. WO-A-01/64823 describes the use of a ceramic composition comprising zinc to protect glassware in an automatic dishwashing process. GB-A-2 372 500 and WO-A-00/39259 describe the use of a soluble glass composition comprising zinc (present in the form of ions) to protect glassware in an automatic dishwashing process. The use of a ceramic/glass zinc containing composition overcomes the problems of poor solubility/precipitation described above whilst offering effective glassware protection.

Bismuth has been used as an additive to aid the prevention of corrosion of glazed glassware corrosion. For example, BE 860180 describes the use of bismuth to avoid damage of decorated, glazed articles.

However, the value of bismuth in this purpose has been diminished by the detrimental effects that the use of bismuth compound has on other components of the washing process or detergent composition. In soluble bismuth compounds can cause the formation of stains on kitchenware items e.g. glassware and cutlery which come into contact with these compounds. For these reasons the use of bismuth alone as a glaze protector has been avoided, although a combination of zinc and bismuth has been found to address this issue (see WO-A-04/106476).

It has also been found that the use of heavy metal compounds in some circumstances reduce the bleaching performance of a dishwashing composition on bleachable stains such as tea stains.

Furthermore, for environmental reasons, it is becoming increasingly desirable to limit (and especially to avoid) the use of heavy metals in detergent formulations.

Moreover, when insoluble materials are incorporated into compositions it is generally necessary to use them in their solid form. As suggested above, this can require careful control of the particle size of the material and can also make them awkward to use in a factory environment as problems such as release of a dust containing the material may occur. It is therefore frequently desirable to use raw materials which are soluble/in liquid form.

A further problem is that the known corrosion prevention agents for non-metallic surfaces, such as glassware corrosion agents, are only effective in the dishwashing cycle in which they are used. Thus if the consumer does not ensure that a composition comprising these agents is used in each cycle then protection against corrosion of non-metallic items is not obtained in each cycle.

Yet another problem some known types of corrosion prevention agents, e.g. zinc containing agent, is they suffer from reduced efficacy in detergent formulations which comprise builders with a strong complexing action such as phosphates and aminocarboxylates.

Still a further problem is that some of the known corrosion prevention agents, such as bismuth containing agents, are in relatively short supply. Accordingly there is always a need to find alternative materials which are more readily available and/or less expensive.

It is an object of the present invention to address one or more of the above problems.

In particular, it is an object of the present invention to provide a corrosion prevention agent/composition which reduces, or avoids, detrimental effects on items treated therewith, e.g. which does not stain such items.

It is a further object of the present invention to provide a corrosion prevention agent/composition which reduces, or avoids, detrimental effects on either i) the other ingredients in the composition into which it is incorporated or ii) which is compatible with strongly complexing builders such as phosphates and aminocarboxylates.

It is still a further object, for environmental reasons, to provide a corrosion prevention agent/composition which does not contain heavy metals, which agent is to be used on non-metallic inorganic items.

Another object is to provide a corrosion prevention agent/composition for non-metallic inorganic items which is readily soluble in water and/or can be provided in liquid or gel form.

Still a further object of the present invention is to provide a corrosion prevention agent/composition for non-metallic inorganic items which agent provides the prevention effect even if it is not used in each cycle of the dishwasher or every time the dishwasher is operated.

Another object of the present invention is to provide a corrosion prevention/composition agent for non-metallic non-inorganic items which is readily available and/or relatively inexpensive compared to such currently available corrosion protection agents.

STATEMENT OF INVENTION

It has now been found that by the use of certain polymeric materials which do not contain heavy metals that one or more of the above problems is/are addressed.

Thus according to the present invention there is provided the use of a composition comprising a polyalkyleneimine and/or a salt or derivative thereof for the prevention of corrosion of non-metallic inorganic items during a washing or rinsing process.

Compositions, such as detergent compositions, comprising polyalkyleneimines such as polyethyleneimines are known.

Detergent compositions comprising up to 5% wt of polyethyleneimine (PEI), are disclosed in WO99/07815. In the detergent compositions disclosed therein the PEI is used as a replacement for phosphonate chelants and are said to provide fabric stain removal properties in the absence of bleaching compounds.

WO99/32272 discloses automatic dishwashing compositions comprising ethoxylated poly(ethyleneimine) as a soil dispersing agent to improve whitening/cleaning benefits.

WO2006/108857 discloses PEI compounds as an additive to laundry detergents and cleaning compositions for removing greasy soil from textiles and hard surfaces.

US2003/0171246 discloses compositions comprising polymer dispersions and a polyethyleneimine to prepare compositions with soil release action which can be used, for example, in the rinse cycle of a domestic washing machine.

WO01/96516 discloses a poly(ethyleneimine) ethoxylate in detergent compositions to be used for cleaning surfaces such as the exterior surface of a vehicle without the subsequent appearance of water-marks thereon. The poly(ethyleneimine) ethoxylate is included in the detergent compositions as soil-suspending polymer.

US2005/0176599 discloses the use of polyalkyleneimines as a cationic charge booster to be used as part of a fragrance carrier system in fabric care products to improve fragrance deposition onto the laundered fabric.

However, none of the aforementioned prior art discloses the use of polyalkyleneimines and/or a salt or derivative thereof for the prevention of corrosion of non-metallic in organic items during a washing or rinsing process.

It is preferred that the cleaning and/or rinsing process of the present invention are carried out on non-metallic inorganic items are glassware such as glass, ceramic, glass ceramic and enamel items to prevent corrosion thereof It is especially preferred that the use according to the present invention occurs in an automatic dishwashing process.

The polyalkyleneimine preferably comprises a polyethyleneimine and most preferably it is a polyethyleneimine.

It is especially preferred that the number average molecular weight of the polyalkyleneimine and/or salt or derivative thereof is in the range of from 100 to 5,000,000.

According to one embodiment of the present invention the composition used is an automatic dishwashing composition comprising the polyalkyleneimine and/or salt or derivative thereof in an amount of from 0.0001 wt % to 50 wt % of the composition.

According to another embodiment the composition used is an automatic dishwashing rinse aid comprising the polyalkyleneimine and/or salt or derivative thereof in an amount of from 0.0005 wt % to 70 wt % of the composition.

According to yet another embodiment the composition used is a water softening salt composition comprising the polyalkyleneimine and/or salt or derivative thereof in an amount of from 0.0001 wt % to 90 wt % of the composition.

In the present invention it is understood that the term non-metallic inorganic item includes items made of glass (such as drinking glasses and plates) which may be decorated (such as with a glaze and or with etching/glass addition). The term non-metallic inorganic item is also understood to include other items of dishware, which may comprise a material other than glass (such as a ceramic). A group of materials called glass ceramics (which have a state intermediate between glass and ceramic) are also encompassed by the term "non-metallic inorganic items. Moreover, items which can have a glass/glaze coating and/or decoration (such as a glazed ceramic plate or which have an enameled layer e.g. an enameled aluminium pan) are also included in the term non-metallic inorganic item.

The term polyalkyleneimine as used herein encompasses any alkyleneimine comprising 2 or more alkyleneimine repeating units, and thus alkyleneimine oligomers, such as ethyleneimine oligomers are included within the term. Typically the polyalkyleneimine will comprise from 2 to 50,000 alkyleneimine repeating units, preferably 10 to 25,000, such as 50 to 10,0000.

Unless otherwise stated or required by the context, all percentages herein are given as weight percentages based on the total weight of the composition. Reference herein to "polyalkyleneimine(s)" includes reference to the salts and/or derivatives thereof.

It has been found that polyalkyleneimines and/or salts or derivatives thereof have especially beneficial properties in the prevention of corrosion of non-metallic inorganic items such as glassware, glass ceramics, ceramics and enamels. This has been found particularly in automatic dishwashing processes. Indeed not only is the composition highly effective at protecting normal glassware but also the composition has been found to be highly effective in protecting glazed glassware/crockery. Thus a single compound may now be used to provide corrosion protection for both decorated glassware/crockery and non-decorated glassware especially in a automatic dishwasher.

Additionally the protection effects on non-metallic inorganic items have been found to be substantive. Namely the beneficial effects e.g. of glass protection and glaze protection have been found to be achieved in subsequent cleaning and/or rinsing cycles (even in the absence of the composition of the present invention in these subsequent cleaning and/or rinsing cycles).

The polyalykyleneimine and/or salts or derivatives thereof is used in an effective amount to provide the aforementioned corrosion protection effects during a washing or rinsing cycle. The polyalkyleneimine is preferably used in a washing or rinsing cycle in an automatic dishwasher in an amount of from 0.01 mg up to 10 g more, preferably from 0.05 mg up to 5 g, more preferably from 0.1 mg up to 1 g and most preferably from 0.5 mg up to 100 mg per wash or rinse cycle. It is also possible to use the polyalkyleneimine in both the wash and the rinse cycles of an automatic dishwashing machine.

Most preferably the polyalykyleneimine is part of a detergent or rinse formulation. The detergent formulation may be any common detergent formulation of the type usually employed with automatic dishwashers. The formulation may comprise a liquid, gel, powder or tablet formulation which can be at least partially packed or filled into a water soluble pouch. Similarly a coating may be used to coat at least a portion of the formulation.

Where the formulation is a liquid/gel generally the polyalykyleneimine is present in solution within the liquid/gel. However, it is also contemplated to have the polyalykyleneimine present in the liquid/gel in the form of an insoluble solid salt/compound so that the polyalykyleneimine may comprise a suspended particle (e.g. such as a "speckle" typically found in these formulations). For compositions having a water soluble coating or pouch it is contemplated to have the polyalykyleneimine as part of the coating/pouch composition.

The detergent formulation normally comprises other components which are typically found in dishwasher detergent formulations. In this regard the detergent formulation typically comprises one or more components selected from the group comprising surfactants (non-ionic, anionic, cationic and zwitterionic), builders, enzymes, foam suppressants, bleaches, bleach activators, thickeners, perfumes, dyes, corrosion inhibitors.

When the polyalykyleneimine is present in an automatic dishwasher detergent composition, the polyalykyleneimine preferably comprises from 0.0001% wt-50% wt of the detergent composition, more preferably from 0.0005% wt-5% wt and most preferably 0.001% wt-1% wt of the dishwasher detergent composition (e.g. 10 mg for a 20 g tablet).

The polyalykyleneimine may be also be included in a rinse aid composition. In this case the rinse aid composition preferably comprises from 0.0005% wt-70% wt of the polyalkyleneimine, more preferably from 0.001% wt-50% wt and most preferably 0.005% wt-25% wt, such as from 0.01% wt-5% wt of the rinse aid composition.

The polyalykyleneimine may be also be included in a water softening salt composition. These are commonly used for the regeneration of the ion exchanger present in an automatic dishwasher. In this case the water softening salt composition preferably comprises from 0.0001% wt-90% wt of the water softening salt composition, more preferably 0.001% wt-50% wt and most preferably 0.005% wt-25% wt such as 0.01 to 10% wt of the water softening salt composition.

The polyalykyleneimine may be included in a machine cleaner/machine additive composition. In either of these cases the composition comprises from 0.0001% wt-90% wt of the composition, more preferably from 0.0005% wt-50% wt and most preferably 0.001% wt-10% wt of the composition.

Polyalkyleneimines are commercially available from different suppliers under various trade names e.g. Lugalvan™ P (ex BASF). Polyalkyleneimines are known to have a very widespread range of average molecular weights, from around 100 up to several million, preferably in the range of from about 100 to about 5,000,000 most preferably of from about 250 to 1,000,000, such as from about 400 to about 100,000. The alkylene group, which is preferably a linear or branched chain, may also for example be cyclic. The alkylene group preferably has from 1 to 50 C atoms, more preferably from 2 to 20, such as from 2 to 5, such as ethylene. These polymers can be linear, branched or end capped. Suitable end-caps include alkylenediamines such as C2-C5 alkylenediamines e.g. ethylenediamines. The polymers may be derivatized e.g. by alkoxylation, ethoxylation, propoxylation protonated, and be provided with or without a counterion. If a counter ion is present any suitable counterion may be used. If a counterion is used which is known to have negative effects in the dishwashing process. e.g. chloride, the chloride counterion is preferably present in the dishwashing process at a concentration of less than 200 mg/liter of dishwashing liquor, more preferably at less than 100 mg/liter most preferably less than 50 mg/liter in order to avoid rusting, pitting or other types of corrosion on stainless steel e.g. cutlery. Common commercially available polyalkyleneimines are usually available as an admixture mixture of one or more of the above species. A solvent such as water may be present. Any one of these species would be suitable for use in the present invention.

The polyalkyleneimines can be incorporated into the compositions in which they are to be included in any suitable manner.

The invention is now further described with reference to the following non-limiting Examples. Further examples will be apparent to the person skilled in the art.

EXAMPLES

In these Examples the detergent composition in Table 1 was used as a detergent formulation base. All percentages are by weight based on the total weight of the composition.

TABLE 1

| Component | % wt |
|---|---|
| Sodium Tripolyphosphate | 45.0 |
| Sodium Carbonate | 24.0 |
| Sodium Bicarbonate | 3.0 |
| Citric acid | 1.0 |
| Cellulose | 1.0 |
| Lactose | 1.0 |
| Sodium disilicate | 3.0 |
| Polyethyleneglycol (PEG) | 7.0 |
| Sodium Percarbonate | 10.0 |
| TAED | 2.0 |
| Protease | 0.9 |
| Amylase | 0.4 |
| Non-ionic Surfactant*[1] | 1.0 |
| Benzotriazole | 0.2 |
| Perfume + Dye | 0.5 |

*[1]Plurafac[RTM] LF500 (ex BASF, Germany)

Test Method

In the examples test glasses were washed 50 times in a special endurance test dishwasher (Bosch® SGS3322).

Cleaning Dosage: 20 g of the base detergent described above in Table 1, optionally further including polyalkyleneimine (with the amount specified in the Examples), with automatic dosing at the beginning of the cleaning cycle.

Water Hardness in the machine: <1 dGH, central softening through ion exchangers, internal ion exchangers not in operation.

Cleaning program 65° C. (both the cleaning and the rinse cycle were operated at 65° C.).

Water consumption per cycle: 20 liters.

There was no soiling on the glassware tested i.e they were new, unsoiled, glasses.

The test report comprised the following types of glass, for each glass pattern 2 samples were examined:

Clear Glasses

Arc-International (France):

"Longchamp", No. 3 17 cl Stemglass, lead crystal glass.

"Arcoroc® Elegance", Wineglass, 14.5 cl.

Nachtmann Bleikristallwerke (Germany):

"Julia Paola", Weißweinkelch No. 2

Royal Leerdam (Netherlands)

"Fiori", 14 cl

Stölze Lausitz GmbH) (Germany):

"Wasserkelch Professional 205 00 11", 450 ml

Decorated Glassware

Ritzenhoff & Breker, (Germany):

"Kinderbecher Flirt",

Leonardo (Germany)

"Latte Macchiato"

Könitz Porzellan GmbH (Germany)

"Longdrink—Saft Escapada Streifen"

The weight loss was determined gravimetrically after 25 to 50 test washes. Visible changes to the glass surface were evaluated in natural light (iridescence, line corrosion and decoration damage) and/or in a special light box (glass clouding, line corrosion and decoration damage). The dimensions of the light box were 70 cm×40 cm×65 cm (l×b×h) and the inside of the box was painted matt black. The box was lit from above with an L 20w/25S (60 cm long) Osram lamp, which was covered in front with a screen. Shelves were disposed in the box on which the glasses were placed for evaluation. The box was open at the front.

The glass corrosion was evaluated using the following criteria; glass clouding (GC), line corrosion (LC), decoration damage (DD) and iridescence (IR). For each parameter a score was given in accordance with the Table below.

| Evaluation | Damage Impact |
|---|---|
| 0 | No damage |
| 1 | First minor damage/hardly visible |
| 2 | Slight damage, visible to expert or in the light box |
| 3 | Visible damage |
| 4 | Strong damage, clearly visible |

Comparative Example 1

The detergent composition of Table 1 was used as a detergent formulation base. The formulation was used in tablet form. The results of the tests are shown in Table 2a (Glass Corrosion) and Table 2b (Mass Loss).

TABLE 2a

| Glass Corrosion | | | | | | |
|---|---|---|---|---|---|---|
| | 25 cycles | | | 50 Cycles | | |
| Glasses | GC | LC | IR | GC | LC | IR |
| Longchamp | 2.0 | 2.0 | 1.0 | 3.0 | 3.0 | 1.0 |
| Julia Paola | 2.5 | 0.5 | 0.5 | 3.0 | 0.5 | 0.5 |
| Stoelzle 205 00 11 | 2.0 | 1.0 | 2.0 | 3.0 | 2.5 | 2.0 |
| Arcoroc$^{RTM}$ Elegance | 3.0 | 2.0 | 1.0 | 3.5 | 3.5 | 1.5 |

TABLE 2a-continued

| Glass Corrosion | | | | | | |
|---|---|---|---|---|---|---|
| Fiori | 2.5 | 2.5 | 1.0 | 3.0 | 3.5 | 1.0 |
| Average | 2.4 | 1.6 | 1.1 | 3.1 | 2.6 | 1.2 |
| Decorated Glassware | DD | | | DD | | |
| Sweet Animals | 2.5 | | | 3.0 | | |
| Latte Macchiato | 3.0 | | | 3.5 | | |
| Escapada | 3.0 | | | 3.5 | | |
| Average | 2.8 | | | 3.3 | | |

TABLE 2b

| Mass Loss | | |
|---|---|---|
| | 25 cycles Mass Loss (mg) | 50 cycles Mass Loss (mg) |
| Glasses | | |
| Longchamp | 34 | 59 |
| Julia Paola | 26 | 56 |
| Stoelzle 205 00 11 | 10 | 34 |
| Arcoroc$^{RTM}$ Elegance | 11 | 14 |
| Fiori | 3 | 13 |
| Sum | 84 | 177 |
| Decorated Glassware | | |
| Sweet Animals | 138 | 289 |
| Latte Macchiato | 27 | 53 |
| Escapada | 235 | 468 |
| Sum | 400 | 810 |

Example 1

In this example 100 mg of polyethyleneimine, ethylenediamine end-capped (average Mw ~800 by LS, average Mn~600 by GPC, ex Sigma Aldrich Co) was added in addition to the detergent composition of Table 1. The results of the tests are shown in Table 3a (Glass Corrosion) and Table 3b (Mass Loss).

TABLE 3a

| Glass Corrosion | | | | | | |
|---|---|---|---|---|---|---|
| | 25 cycles | | | 50 Cycles | | |
| Glasses | GC | LC | IR | GC | LC | IR |
| Longchamp | 1.5 | 1.0 | 1.5 | 2.0 | 1.0 | 1.0 |
| Julia Paola | 0.5 | 0.5 | 0.5 | 1.0 | 0.5 | 0.5 |
| Stoelzle 205 00 11 | 2.0 | 1.5 | 1.5 | 2.0 | 1.5 | 1.5 |
| Arcoroc$^{RTM}$ Elegance | 2.0 | 1.5 | 1.5 | 2.5 | 2.0 | 1.0 |
| Fiori | 0.5 | 1.0 | 1.0 | 1.0 | 1.5 | 1.0 |
| Average | 1.3 | 1.1 | 1.2 | 1.7 | 1.3 | 1.0 |
| Decorated Glassware | DD | | | DD | | |
| Sweet Animals | 2.5 | | | 3.0 | | |
| Latte Macchiato | 2.0 | | | 2.0 | | |
| Escapada | 2.0 | | | 2.5 | | |
| Average | 2.2 | | | 2.5 | | |

TABLE 3b

| Mass Loss | 25 cycles Mass Loss (mg) | 50 cycles Mass Loss (mg) |
|---|---|---|
| Glasses | | |
| Longchamp | 8 | 14 |
| Julia Paola | 6 | 14 |
| Stoelzle 205 00 11 | 5 | 10 |
| Arcoroc$^{RTM}$ Elegance | 1 | 3 |
| Fiori | 4 | 5 |
| Sum | 24 | 47 |
| Decorated Glassware | | |
| Sweet Animals | 56 | 111 |
| Latte Macchiato | 12 | 28 |
| Escapada | 88 | 184 |
| Sum | 156 | 323 |

In contrast to Comparative Example 1 the addition of 100 mg (0.5 wt %) polyethyleneimine, ethylenediamine end capped provides both non-decorated glassware corrosion protection and decorated glassware protection. The visual surface damage and the mass loss on the test glasses were reduced with the composition of Example 1 compared to washing with the comparative detergent composition of Table 1.

Additionally a long-term corrosion protection benefit was observed with Example 1. Following the test with the polyethyleneimine, ethylenediamine end capped the test of the Comparative Example 1 (using the detergent of Table 1 and a new set of dishware) was repeated in the automatic dishwasher used for the test of Example 1. Surprisingly, even though no polyalkyleneimine had been added to the formulation of Comparative Example 1 less damage occurred to clear and decorated glassware than would have been expected from the results shown above obtained for Comparative Example 1.

Without intending to be bound by any theory, it is postulated that the polyalkyleneimine may be absorbed/adsorbed onto parts of the dishwasher (e.g. tubes, spray-arms, racks, sieves) and is released over a number of cycles thereafter thus providing a corrosion protection benefit in subsequent cycles.

Accordingly, for any new test the dishwasher had to be "cleaned" for 50 cycles with the detergent of Table 1 without adding any polyalkyleneimine, otherwise the polyalkyleneimine "residues" inside the dishwasher could have influenced the results of any subsequent test.

Example 2

In this example 100 mg of ethyleneimine, oligomer mixture; a mixture of linear and branched chains and with 5-25% wt tetraethylenepentamine (average Mn~423, ex Sigma Aldrich Co) was added in addition to the detergent composition of Table 1. The results of the tests are shown in Table 4a (Glass Corrosion) and Table 4b (Mass Loss).

TABLE 4a

| Glass Corrosion | 25 cycles | | | 50 Cycles | | |
|---|---|---|---|---|---|---|
| Glasses | GC | LC | IR | GC | LC | IR |
| Longchamp | 0.5 | 0.5 | 1.0 | 1.5 | 0.5 | 1.0 |
| Julia Paola | 0.0 | 0.0 | 0.5 | 1.0 | 0.5 | 0.5 |
| Stoelzle 205 00 11 | 1.0 | 0.5 | 1.0 | 1.0 | 1.0 | 1.0 |
| Arcoroc$^{RTM}$ Elegance | 2.0 | 1.5 | 1.0 | 2.5 | 2.0 | 1.0 |
| Fiori | 0.0 | 0.5 | 0.5 | 0.5 | 1.0 | 1.0 |
| Average | 0.7 | 0.6 | 0.8 | 1.3 | 1.0 | 0.9 |
| Decorated Glassware | DD | | | DD | | |
| Sweet Animals | 3.0 | | | 3.5 | | |
| Latte Macchiato | 3.0 | | | 3.5 | | |
| Escapada | 2.5 | | | 3.5 | | |
| Average | 2.8 | | | 3.5 | | |

TABLE 4b

| Mass Loss | 25 cycles Mass Loss (mg) | 50 cycles Mass Loss (mg) |
|---|---|---|
| Glasses | | |
| Longchamp | 9 | 13 |
| Julia Paola | 3 | 12 |
| Stoelzle 205 00 11 | 1 | 10 |
| Arcoroc$^{RTM}$ elegance | 5 | 11 |
| Fiori | 6 | 9 |
| Sum | 23 | 53 |
| Decorated Glassware | | |
| Sweet Animals | 102 | 213 |
| Latte Macchiato | 7 | 26 |
| Escapada | 160 | 300 |
| Sum | 269 | 539 |

In contrast to Comparative Example 1 the addition of 100 mg (0.5 wt %) of the ethyleneimine, oligomer mixture above provides non-decorated glassware corrosion protection. The visual surface modifications and the mass loss on the test glasses were reduced compared to Comparative Example 1.

For decorated glassware the addition of the ethyleneimine, oligomer mixture above reduced the mass loss of these decorated glassware.

Example 3

In this example 1 mg (0.005 wt %) of branched polyethyleneimine (average Mw ~25,000 by LS, average Mn ~10,000 by GPC, ex Sigma Aldrich Co) was added to the detergent composition of Table 1. The results of the tests are shown in Table 5a (Glass Corrosion) and Table 5b (Mass Loss).

TABLE 5a

| Glass Corrosion | 25 cycles | | | 50 Cycles | | |
|---|---|---|---|---|---|---|
| Glasses | GC | CL | IR | GC | CL | IR |
| Longchamp | 1.5 | 1.5 | 1.0 | 2.5 | 1.5 | 1.0 |
| Julia Paola | 1.0 | 0.5 | 1.5 | 1.5 | 0.5 | 1.5 |

TABLE 5a-continued

| Glass Corrosion | | | | | | |
|---|---|---|---|---|---|---|
| Stoelzle 205 00 11 | 2.0 | 1.0 | 2.0 | 2.5 | 1.5 | 1.5 |
| Arcoroc$^{RTM}$ Elegance | 2.5 | 2.0 | 1.5 | 2.5 | 2.0 | 1.5 |
| Fiori | 1.5 | 1.5 | 1.0 | 2.0 | 1.5 | 1.0 |
| Average | 1.7 | 1.3 | 1.4 | 2.2 | 1.4 | 1.3 |
| Decorated Glassware | DD | | | DD | | |
| Sweet Animals | 2.5 | | | 3.0 | | |
| Latte Macchiato | 2.5 | | | 3.0 | | |
| Escapada | 2.0 | | | 2.5 | | |
| Average | 2.3 | | | 2.8 | | |

TABLE 5b

| Mass Loss | 25 cycles Mass Loss (mg) | 50 cycles Mass Loss (mg) |
|---|---|---|
| Glasses | | |
| Longchamp | 11 | 15 |
| Julia Paola | 10 | 19 |
| Stoelzle 205 00 11 | 8 | 19 |
| Arcoroc$^{RTM}$ elegance | 5 | 9 |
| Fiori | 2 | 5 |
| Sum | 38 | 67 |
| Decorated Glassware | | |
| Sweet Animals | 88 | 192 |
| Latte Macchiato | 22 | 28 |
| Escapada | 132 | 299 |
| Sum | 242 | 518 |

The addition of only 1 mg (0.005 wt %) of branched polyethylenimine, provides non-decorated glassware corrosion protection and decorated glassware protection. Glass clouding, line corrosion, décor damage and mass loss are all reduced.

Example 4

In this example a bleach and phosphorus-free detergent composition base as shown in Table 6 was used as a base formulation. The formulation was used in tablet form (having a mass of 20 g) with 1 tablet per wash being dispensed at the beginning of the main wash.

The protection performance on glasses and decoration with 100 mg of Lugalvan P™ (ex BASF, Germany) used in addition to the tablet is shown in Table 7a (Glass Corrosion) and Table 7b (Mass Loss).

TABLE 6

| Component | % |
|---|---|
| Methylglycine Diacetate (MGDA) | 62.0 |
| Sodium Carbonate | 9.0 |
| Surfactants*[2] | 6.0 |
| Acrylic/sulphonic copolymer*[3] | 5.0 |
| Polyacrylic acid*[4] | 5.0 |
| PVP-Copolymer*[5] | 2.0 |
| Sodium Disilicate | 3.0 |
| Polyethylenglycol (PEG) | 5.0 |
| Protease | 1.5 |
| Amylase | 0.5 |

TABLE 6-continued

| Component | % |
|---|---|
| Anti-Foam | 0.5 |
| Perfume + Dye | 0.5 |

*[2]mixture of; 2% wt C16-C18 fatty alcohol 25 EO, 1% wt Dehypon ® 3697 GRA M (modified fatty alcohol polyglycolether ex Cognis) and 3% wt Plurafac ® LF305 (fatty alcohol alcoxylate ex BASF).

*[3]Norasol™ LMW 45 (ex Fa. NorsoHaas)

*[4]Acusol™ 445 NG (polyacrylic acid homopolymer ex Rohm & Haas)

*[5]Luvitec™ VA 64 (ex BASF)

TABLE 7a

| Glass Corrosion | 50 cycles detergent from Table 6 | | | 50 Cycles detergent from Table 6 + 100 mg Lugalvan P ™ | | |
|---|---|---|---|---|---|---|
| Glasses | GC | LC | IR | GC | LC | IR |
| Longchamp | 3.5 | 3.5 | 0.5 | 2.0 | 1.5 | 1.0 |
| Julia Paola | 2.0 | 0.5 | 1.5 | 1.0 | 0.5 | 1.5 |
| Stoelzle 205 00 11 | 2.5 | 3.5 | 0.5 | 1.0 | 1.5 | 0.5 |
| Arcoroc$^{RTM}$ Elegance | 3.5 | 4.0 | 1.5 | 2.0 | 2.5 | 1.5 |
| Fiori | 3.5 | 4.0 | 2.0 | 1.5 | 2.0 | 1.5 |
| Average | 3.0 | 3.1 | 1.2 | 1.5 | 1.6 | 1.2 |
| Decorated Glassware | DD | | | DD | | |
| Sweet Animals | 4.0 | | | 2.5 | | |
| Latte Macchiato | 3.5 | | | 2.0 | | |
| Average | 3.8 | | | 2.3 | | |

TABLE 7b

| Mass Loss | 50 cycles detergent from Table 6 Mass Loss (mg) | 50 Cycles detergent from Table 6 + 100 mg Lugalvan P ™ Mass Loss (mg) |
|---|---|---|
| Glasses | | |
| Longchamp | 115 | 15 |
| Julia Paola | 132 | 18 |
| Stoelzle 205 00 11 | 94 | 17 |
| Arcoroc$^{RTM}$ Elegance | 50 | 10 |
| Fiori | 46 | 8 |
| Sum | 437 | 68 |
| Decorated Glassware | | |
| Sweet Animals | 420 | 110 |
| Latte Macchiato | 95 | 36 |
| Sum | 515 | 146 |

The use of 100 mg (0.5 wt %) Lugalvan P™ in addition to the detergent tablet, provides non-decorated glassware corrosion protection and decorated glassware protection. Glass clouding, line corrosion, décor damage and mass loss after 50 dishwashing cycles are reduced dramatically.

Example 5

In this example the ethyleneimine oligomer mixture used in Example 2 was added to the rinse aid composition shown in Table 8.

TABLE 8

| Component of Rinse Aid | % |
|---|---|
| Nonionic Surfactant*6 | 13.0 |
| Na-Cumene Sulphonate | 3.0 |
| Citric acid | 0.7 |
| Potassium Sorbate | 0.099 |
| Biocide | 0.001 |
| Water | 79.9 |
| Polyalkyleneimine oligomer mixture (average Mn~423) | 3.3 |

*6Plurafac$^{RTM}$ LF 221 (ex BASF)

3 ml of the rinse aid composition was added at the beginning of the automatic dishwasher rinse cycle. In the main wash cycle the detergent of Comparative Example 1 was used The protection performance on glasses and decoration is shown in Table 9a (Glass Corrosion) and Table 9b (Mass Loss).

TABLE 9a

| Glass Corrosion | | | | | | |
|---|---|---|---|---|---|---|
| | 25 cycles | | | 50 Cycles | | |
| Glasses | GC | LC | IR | GC | LC | IR |
| Longchamp | 2.0 | 1.5 | 1.0 | 2.5 | 1.5 | 1.0 |
| Julia Paola | 2.5 | 0.5 | 2.0 | 2.5 | 0.5 | 1.5 |
| Stoelzle 205 00 11 | 2.0 | 1.0 | 1.0 | 2.5 | 1.5 | 1.0 |
| Arcoroc$^{RTM}$ Elegance | 2.5 | 1.5 | 2.0 | 2.5 | 2.0 | 2.0 |
| Fiori | 2.0 | 2.0 | 1.0 | 2.5 | 1.5 | 1.5 |
| Average | 2.2 | 1.3 | 1.4 | 2.5 | 1.4 | 1.4 |
| Decorated Glassware | DD | | | DD | | |
| Sweet Animals | 2.5 | | | 2.5 | | |
| Latte Macchiato | 3.0 | | | 3.0 | | |
| Escapada | 2.5 | | | 3.0 | | |
| Average | 2.7 | | | 2.8 | | |

TABLE 9b

| Mass Loss | | |
|---|---|---|
| | 25 cycles Mass Loss (mg) | 50 cycles Mass Loss (mg) |
| Glasses | | |
| Longchamp | 5 | 10 |
| Julia Paola | 14 | 34 |
| Stoelzle 205 00 11 | 10 | 11 |
| Arcoroc$^{RTM}$ Elegance | 9 | 14 |
| Fiori | 8 | 12 |
| Sum | 46 | 80 |

TABLE 9b-continued

| Mass Loss | | |
|---|---|---|
| | 25 cycles Mass Loss (mg) | 50 cycles Mass Loss (mg) |
| Decorated Glassware | | |
| Sweet Animals | 72 | 155 |
| Latte Macchiato | 13 | 34 |
| Escapada | 154 | 333 |
| Sum | 239 | 522 |

The rinse aid provides non-decorated glassware corrosion protection and decorated glassware protection. Glass clouding, line corrosion, décor damage and mass loss are reduced.

The invention claimed is:

1. A method of preventing the corrosion of non-metallic inorganic items during a washing or rinsing process, the method comprising the steps of:

providing to an automatic dishwashing machine a composition which comprises a polyalkyleneimine, a salt of polyalkyleneimine and/or a derivative of polyalkyleneimine; and, contacting the items within the automatic dishwashing machine with an aqueous composition comprising the polyalkyleneimine, the salt of polyalkyleneimine and/or the derivative of polyalkyleneimine during the washing or rinsing process;

wherein the weight of the polyalkyleneimine, the salt of polyalkyleneimine and/or the derivative of polyalkyleneimine that is provided to the automatic dishwashing machine is 0.01 mg to 10 mg per wash or rinse cycle; and wherein the number average molecular weight of the polyalkyleneimine, the salt of polyalkyleneimine and/or the derivative of polyalkyleneimine is in the range of from 100 to less than 1,000.

2. The method according to claim 1, wherein the items comprise glassware, glass ceramics, ceramics or enamel.

3. The method according to claim 1, wherein the polyalkyleneimine, the salt of polyalkyleneimine and/or the derivative of polyalkyleneimine comprises a polyethyleneimine, a salt of polyethyleneimine and/or a derivative of polyethyleneimine.

4. The method according to claim 3, wherein the composition comprises a polyethyleneimine.

5. The method according to claim 1, wherein the composition is an automatic dishwashing rinse aid composition and the weight of the polyalkyleneimine, the salt of polyalkyleneimine and/or the derivative of polyalkyleneimine that is provided to the automatic dishwashing machine is 0.01 mg to 10 mg per rinse cycle.

6. The method according to claim 1, wherein the composition is a water softening composition.

7. The method according to claim 1, wherein the composition is a machine cleaner composition or machine additive composition.

* * * * *